US009053664B2

(12) United States Patent
Lee

(10) Patent No.: US 9,053,664 B2
(45) Date of Patent: Jun. 9, 2015

(54) METHOD FOR CONTROLLING BRIGHTNESS IN A DISPLAY DEVICE BASED ON THE AVERAGE LUMINANCE OF A VIDEO SIGNAL AND DISPLAY DEVICE USING THE SAME

(75) Inventor: Wook Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 340 days.

(21) Appl. No.: 13/539,993

(22) Filed: Jul. 2, 2012

(65) Prior Publication Data

US 2013/0127924 A1 May 23, 2013

(30) Foreign Application Priority Data

Nov. 18, 2011 (KR) ..... 10-2011-0120913

(51) Int. Cl.
*G09G 5/10* (2006.01)
*G09G 3/32* (2006.01)

(52) U.S. Cl.
CPC ..... *G09G 3/32* (2013.01)

(58) Field of Classification Search
USPC ..... 345/82, 690, 76, 102
See application file for complete search history.

(56) References Cited

U.S. PATENT DOCUMENTS

2003/0122759 A1* 7/2003 Abe et al. ..... 345/89
2004/0041766 A1* 3/2004 Nakao et al. ..... 345/89
2004/0108998 A1* 6/2004 Imamura ..... 345/204
2006/0170623 A1* 8/2006 Naugler et al. ..... 345/76
2007/0262932 A1* 11/2007 Tang et al. ..... 345/77
2007/0296663 A1* 12/2007 Goetz et al. ..... 345/87
2008/0246699 A1* 10/2008 Oh ..... 345/76
2009/0066715 A1* 3/2009 Chen ..... 345/589
2009/0201231 A1* 8/2009 Takahara et al. ..... 345/76
2010/0033513 A1* 2/2010 Choi et al. ..... 345/690
2010/0220108 A1* 9/2010 Park et al. ..... 345/589

FOREIGN PATENT DOCUMENTS

JP 2004-184489 A 7/2004
JP 2011-141412 A 7/2011
KR 10-0707619 B1 4/2007
KR 10-2011-0050147 A 5/2011

* cited by examiner

*Primary Examiner* — Jonathan Blancha

(74) *Attorney, Agent, or Firm* — Knobbe, Martens, Olson & Bear, LLP

(57) ABSTRACT

A luminance control method of a display device is provided to control luminance of a display device. The display device has a display unit having a plurality of pixels emitting light. In some aspects, the luminance control method includes receiving a luminance level, applying a first luminance control method if the received luminance level is less than a reference luminance level, calculating an average value of video data for each frame if the luminance level is greater than the reference luminance level, applying the first luminance control method if the average value is less than a reference gray level value, and applying a second luminance control method if the average value is greater than the reference gray value level.

23 Claims, 12 Drawing Sheets

METHOD FOR CONTROLLING BRIGHTNESS IN A DISPLAY DEVICE BASED ON THE AVERAGE LUMINANCE OF A VIDEO SIGNAL AND DISPLAY DEVICE USING THE SAME

CROSS-REFERENCE TO RELATED APPLICATIONS

This application claims priority to and the benefit of Korean Patent Application No. 10-2011-0120913 filed in the Korean Intellectual Property Office on Nov. 18, 2011, the entire contents of which are incorporated herein by reference.

BACKGROUND

1. Field

The disclosed technology relates to a luminance control method of a display device, and a display device using the same. More particularly, the technology relates to a driving method for luminance control in an organic light emitting diode (OLED) display and a display device employing the same.

2. Description of the Related Technology

In recent years, various flat panel displays having weight and volume as compared with a cathode ray tube have been developed. A flat panel display may, for example, be a liquid crystal display (LCD), a field emission display (FED), a plasma display panel (PDP), or an organic light emitting diode (OLED) display.

An organic light emitting diode display refers to a flat display device using an electro-luminescence phenomenon of an organic material in an organic light emitting diode. The organic light emitting diode emits light when electrons and holes are injected from electrodes and the injected electrons and holes recombine.

The organic light emitting diode display has reduced volume and weight at least because an additional light source is not required. Such a display may be used in an electronic product such as a portable terminal or a large-sized television with advantages of high luminance and high-speed reaction.

In general, most data displayed in a large-sized organic light emitting diode display has significantly low luminance compared to the maximum luminance that can be displayed in the organic light emitting diode display. When the organic light emitting diode display is continuously operated at levels near the maximum luminance, the life span of the organic light emitting diode is shortened due to an excessive amount of driving current. Thus, unlike a liquid crystal display device, a large-sized organic light emitting diode display benefits from luminance control to reduce luminance by controlling a driving current of the organic light emitting diode.

In general, to compensate for scattering or deviation in a display module of the display, a luminance table formed of pre-set gamma data for generating several luminance steps and gray levels corresponding to luminance is provided and gamma data compensated by performing interpolation on the pre-set gamma data is continuously calculated by applying a predetermined compensation equation to control luminance such that compensation corresponding to the controlled luminance step is performed.

However, the interpolation of the pre-set gamma data is linear in a high gray level region and is non-linear in a low gray level region due to the characteristics of the organic light emitting diode display, and therefore, when the interpolation is applied at once, an optical characteristic becomes instable and inconsistent over the entire gray level range, thereby causing deterioration of image quality.

Further, the gamma data interpolation usually sets a reference luminance level to the highest luminance level, and thus the life-span of the diodes may be shortened, and particularly, a variation amount of an optical characteristic in a low gray level region of which a luminance level is low cannot be easily predicted or duplicated. An organic material of a light emission element of the display device may be changed for use with a low temperature poly-silicon (LTPS) process or process scattering and thus a variation amount of the optical characteristic becomes further difficult to predict in a lower gray level region, and accordingly work efficiency for compensation of the luminance scattering significantly suffers and luminance scattering or deviation cannot be compensated in the lowest luminance level.

Thus, luminance-specific non-uniformity needs to be improved by developing a luminance control method in a low luminance region, and a luminance compensation method of a display device to prevent life-span deterioration of the diode material of an organic light emitting element in luminance control is desirable.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One inventive aspect is a method of controlling luminance of a display device including a display unit having a plurality of pixels emitting light with a driving current corresponding to video data during a light emission period according to a light emission control signal transmitted through a plurality of light emission control lines. The method includes receiving a luminance level applying a first luminance control method if the luminance level is less than a reference luminance level, calculating an average value of video data for each frame if the luminance level is greater than the reference luminance level, applying the first luminance control method if the average value is less than a reference gray level value, and applying a second luminance control method if the average value is greater than the reference gray level value.

Another inventive aspect is a display device. The display device includes a display unit having a plurality of pixels respectively connected to a plurality of scan lines, a plurality of light emission control lines, and a plurality of data lines. The pixels emit light with a driving current during a light emission period according to a light emission control signal transmitted through the light emission control line. The display device also includes a controller configured to determine a luminance control method by comparing a received luminance level with a reference luminance level, and based on the comparison, to conditionally determine a luminance control method by calculating an average value of gray level data included in video data for each frame and comparing the average value with a predetermined reference gray value level.

DETAILED DESCRIPTION OF CERTAIN INVENTIVE EMBODIMENTS

Figure 1:
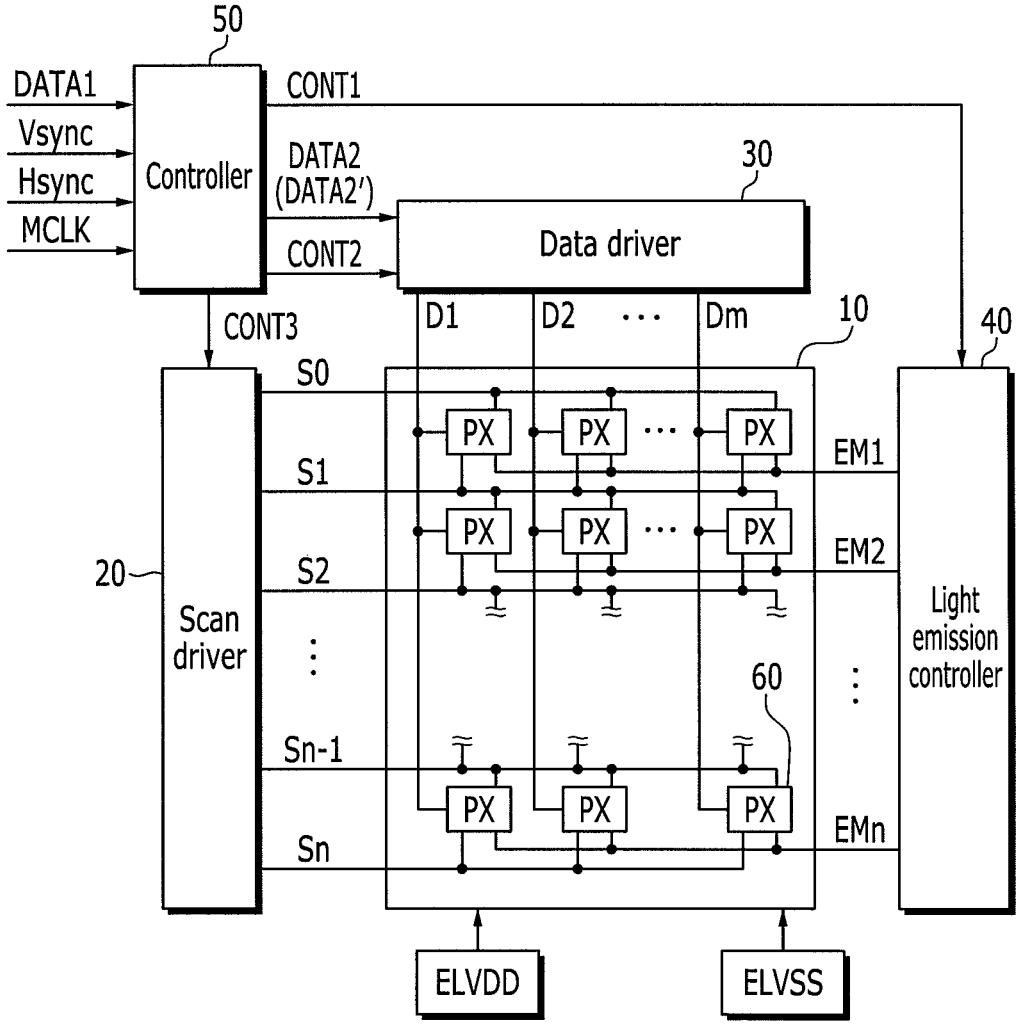
FIG. 1 is a block diagram of a display device according to an exemplary embodiment.

Various aspects are described more fully hereinafter with reference to the accompanying drawings, in which exemplary embodiments are shown. As those skilled in the art would realize, the described embodiments may be modified in various ways, without departing from the spirit or scope of the present invention. In addition, in various exemplary embodiments, the same reference numerals are generally used for like elements and may illustrated only in the first exemplary embodiment. Accordingly, like elements in subsequent embodiments may not be described or shown.

The drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment. Referring to FIG. 1, the display device includes a display unit 10 including a plurality of pixels 60, a scan driver 20, a data driver 30, a light emission control driver 40, a controller 50, and a power supply supplying a first voltage ELVDD and a second voltage ELVSS.

The display unit 10 includes a plurality of signal lines S0-Sn, D1-Dm, and EM1-EMn and a plurality of pixel circuits 60 respectively connected to the signal lines. The pixel circuits 60 are arranged approximately in a matrix format. The signal lines S0-Sn, D1-Dm, and EM1-EMn include a plurality of scan lines S0 to Sn transmitting a scan signal, a plurality of data lines D1 to Dm transmitting a data signal, and a plurality of light emission control lines EM1 to EMn transmitting a light emission control signal. The scan lines S0 to Sn and the light emission control line EM1 to EMn are substantially extended in a row direction and almost parallel with each other, and the data lines D1 to Dm are extended substantially in a column direction and almost parallel with each other.

As shown in FIG. 1, each of a plurality of pixels included in one pixel row is connected to a scan lines corresponding to the corresponding pixel row, a scan line corresponding to the previous pixel row of the corresponding pixel row, and a light emission control line corresponding to the corresponding pixel row. A plurality of pixels included in the first pixel row are connected to a dummy scan line S0, the first scan line S1 corresponding to the first pixel row, and the first light emission control line EMn corresponding to the first pixel row. In addition, each of the plurality of pixels included in one pixel line are connected to data lines respectively corresponding to the pixel lines and receive data signals.

The pixel circuit 60 includes a light emitting element (e.g., organic light emitting diode OLED). The light emitting element is connected to a power supply supplying the first voltage ELVDD and the second voltage ELVSS. In further detail, a first terminal and a second terminal of the organic light emitting diode OLED are electrically connected to the first voltage ELVDD and the second voltage ELVSS, respectively, and the organic light emitting diode OLED emits light according to a current flowing between the two terminals. Here, the current flowing between the two terminals of the light emitting element is referred to as a driving current Ioled.

Each pixel circuit generates the driving current Ioled according to a video data signal, the first voltage ELVDD, and the second voltage ELVSS and supplies the driving current Ioled to the organic light emitting diode OLED, and the organic light emitting diode OLED emits light with brightness based on the driving current Ioled. Here, the first voltage ELVDD may be higher than the second voltage ELVSS.

The scan driver 20 generates a plurality of scan signals according to a scan driving control signal CONT3 transmitted from the controller 50 and transmits the scan signals to the scan lines scan line S0 to Sn. That is, the scan driver 20 applies the scan signal to the display unit 10 for every predetermined period (e.g., horizontal synchronization signal Hsync period) by control of the scan driving control signal CONT3. A scan signal is transmitted to each of the plurality of pixels included in one pixel row among the plurality of pixel rows included in the display unit 10 from the scan line corresponding to the previous pixel row such that a data voltage according to the video data signal transmitted from the previous frame can be reset. In addition, a scan signal is transmitted from a scan line corresponding to the corresponding pixel row to each of the plurality of pixels included in the pixel row, and the scan signal activates the corresponding pixel to transmit a video data signal to the pixel circuit.

The data driver 30 receives a plurality of video data signals DATA2 and DATA2' transmitted from the controller 50, and generates a plurality of video data signals for each pixel row and sequentially transmits the data signals through the plurality of data lines D1 to Dm. That is, the data driver 30 applies the video data signals DATA2 and DATA2' for every specific period (e.g., a vertical synchronization signal Vsync period) by control of a data driving control signal CONT2 transmitted from the controller 50. In this case, the video data signals DATA2 and DATA2' applied to the data driver 30 are variously converted according to an embodiment of a luminance control method as described further below. Accordingly, the video data signal DATA2 may be compensated from the external video signal DATA1 using a gamma data interpolation method, or the video data signal DATA2' may be converted from the external video signal DATA1 for a driving method of the display device according to a method for performing luminance control through a duty ratio of a light emission control signal. The conversion of the video data signal and the luminance control method is described in further detail with reference to the corresponding drawings.

The light emission control driver 40 generates a plurality of light emission control signals according to a light emission driving control signal CONT1 transmitted from the controller 50 and transmitting the signals to the respective light emission control lines EM1 to EMn. That is, the light emission control driver 40 applies the light emission control signal to the display unit 10 for every specific period (e.g., horizontal synchronization signal Hsync period) by control of the light emission driving control signal CONT1. The plurality of light emission control signals control light emission duty ratio of a pixel. That is, the light emission duty ratio of the plurality of light emission control signals may be controlled by the light emission driving control signal CONT1 including information of an off duty ratio width of a pulse calculated for application of a luminance control method according to the exemplary embodiment.

The controller 50 receives a video data signal DATA 1, a horizontal synchronization signal Hsync, a vertical synchronization signal Vsync, and a main clock signal MCLK from an external source, and outputs the video data signals DATA2 and DATA2' converted corresponding to the scan driving control signal CONT3, the data driving control signal CONT2, the light emission driving control signal CONT1, and the video data signal DATA1 for displaying an image according to the video data signal DATA1 in the display unit 10. Here, the video data signal DATA1 includes a plurality of gray level data controlling luminance of each of the plurality of pixels. The video data signal DATA1 may correspond to color display signals (R, G, and B signals) that respectively correspond to colors when the plurality of pixels included in the display unit 10 are formed of subpixels respectively displaying basic 3 primary colors R, G, and B. In addition, the controller 50 may output the video data signals DATA2 and DATA2' converted from video data signal DATA1, that is, RGB signals.

The controller 50 may include a configuration unit for application of the luminance control method according to various embodiments. A configuration and a function of the controller 50 will be described in further detail with reference to FIG. 3.

Figure 2:
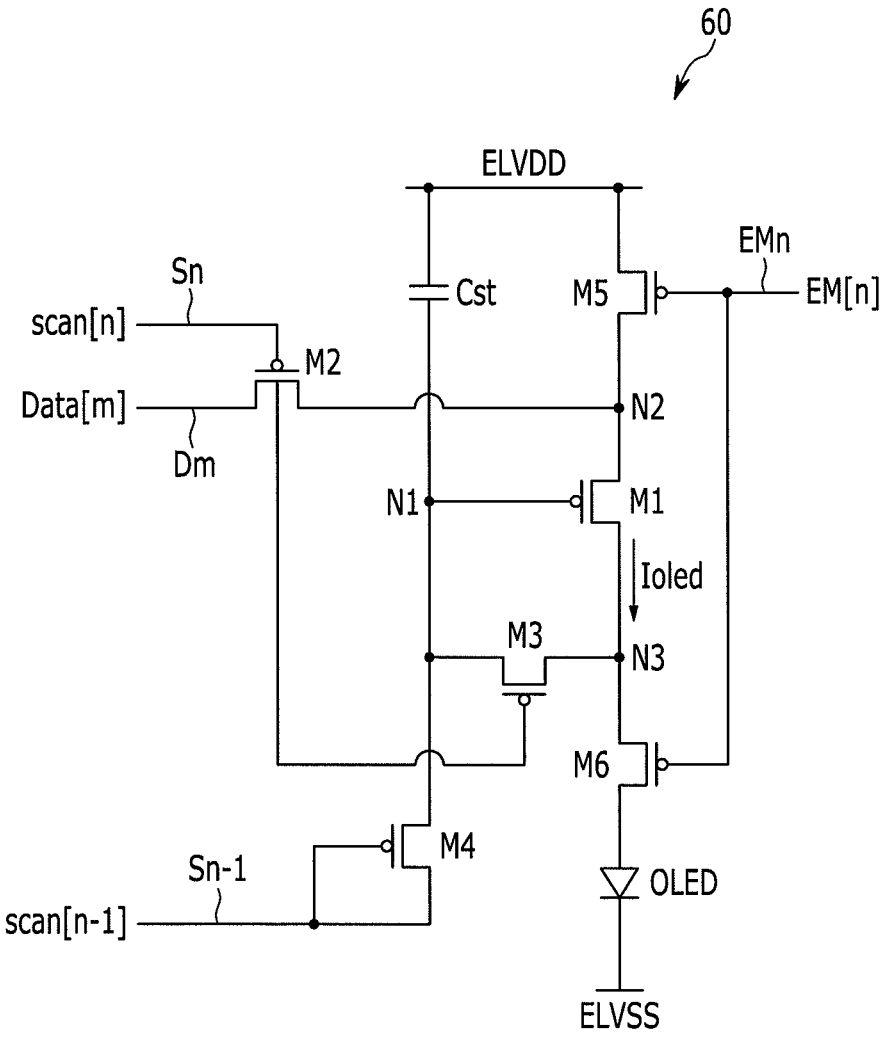
FIG. 2 is a circuit diagram of a pixel circuit of FIG. 1.

FIG. 2 is a circuit diagram of a circuit of the pixel 60 of FIG. 1. In further detail, FIG. 2 illustrates a circuit diagram of the pixel 60 corresponding to the n-th pixel row and the m-th pixel column among the plurality of pixels of the display unit 10 that is formed of a matrix having n pixel rows and m pixel columns (lines). The pixel 60 is connected to the (n−1)th scan line Sn−1 and the n-th scan line Sn among the plurality of scan lines, the n-th light emission control line EMn among the plurality of light emission control lines, and the m-th data line Dm among the plurality of data lines. The pixel 60 includes an organic light emitting diode OLED, a driving transistor M1, a switching transistor M2, a threshold voltage compensation transistor M3, a reset transistor M4, light emission control transistors M5 and M6, and a capacitor Cst. The circuit of FIG. 2 is formed of 6 transistors and one capacitor, but the present invention is not limited thereto. Thus, connection of the circuit element may be variously modified for performance of a function to control a light emission period while displaying an image according to a video data signal.

Referring to FIG. 2, the driving transistor M1 includes a gate connected to a first node N1 to which a first terminal of the capacitor Cst is connected, a first terminal connected to a second node N2 to which a first terminal of a first light emission control transistor M5 is connected, and a second terminal connected to a third node N3 to which a first terminal of a second light emission control transistor M6 is connected. In further detail, the second terminal of the driving transistor M1 is connected with the organic light emitting diode OLED through the second light emission control transistor M6 while being connected to the first terminal of the second light emission control transistor M6. The driving transistor M1 allows the driving current Ioled that varies in magnitude depending on a voltage between the gate and the first terminal to the organic light emitting diode OLED.

The switching transistor M2 includes a gate connected with the scan line Sn, a first terminal connected with the data line Dm, and a second terminal connected with the second node N2. If turned on by the scan signal scan[n] applied to the scan line Sn, the switching transistor M2 transmits a data voltage according to the corresponding video data signal Data[m] applied to the data line Dm to the first terminal of the driving transistor M1.

The threshold voltage compensation transistor M3 includes a gate connected with the scan line Sn, a first terminal connected with the first node N1, and a second terminal connected with the third node N3. The first terminal and the second terminal of the threshold voltage compensation transistor M3 are respectively connected with the gate and the second terminal of the driving transistor M1. Since each transistor is formed of a PMOS transistor in the circuit diagram of FIG. 2, the first terminal and the second terminal of the threshold voltage compensation transistor M3 are connected with the gate and the drain of the driving transistor M1. If turned on by the scan signal scan[n] applied to the scan line Sn, the threshold voltage compensation transistor M3 diode-connects the driving transistor M1. The scan signal scan[n] applied to the scan line Sn is simultaneously transmitted to the switching transistor M2 and the threshold voltage compensation transistor M3, and therefore a data voltage Vdata according to the corresponding video data signal Data[m] is applied to the first terminal of the driving transistor M1 and a voltage (Vdata−Vth) dropped by a threshold voltage of the driving transistor M1 from the data voltage is applied to the gate of the driving transistor M1. The gate of the driving transistor M1 is connected to the first terminal of the capacitor Cst, and therefore the voltage (Vdata−Vth) is maintained by the capacitor Cst. Since the voltage (Vdata−Vth) to which the threshold voltage Vth of the driving transistor M1 is reflected is applied to the gate and then maintained, the driving current flowing to the driving transistor M1 is not influenced by the threshold voltage. Therefore, a deviation with respect to the threshold voltage of the driving voltage of each pixel can be compensated in generation of the driving current corresponding to the video data signal.

The reset transistor M4 includes a gate connected with the (n−1)th scan line Sn−1 corresponding to the (n−1)th pixel row, that is, the previous pixel row of the n-th pixel row, a first terminal connected again with the (n−1)th scan line (Sn−1), and a second terminal connected with the first node N1. Referring to the circuit diagram of FIG. 2, the reset transistor M4 is a PMOS transistor, and thus, the reset transistor M4 is turned on if a scan signal scan[n−1] having a low level voltage is applied to the (n−1)th scan line, and simultaneously the low level voltage applied to the (n−1)th scan line is applied to the gate of the driving transistor M1 as a reset voltage. That is, the reset voltage is applied to the first node N1 and thus a data voltage corresponding to the previous frame, stored in the capacitor Cst is reset.

Because the plurality of scan signals are sequentially applied to the plurality of scan lines for each pixel row, the scan signal scan[n−1] having the low level voltage is applied to the pixel 60 of FIG. 2 through the (n−1)th scan line Sn−1 before the scan signal scan[n] is applied to the pixel 60 through the n-th scan line Sn, and thus the reset transistor M4 is turned on before application of the data voltage in the corresponding frame such that the voltage stored in the capacitor Cst is stored as the reset voltage. In this case, the reset voltage is set to be the low level voltage of the scan signal scan[n−1] in the exemplary embodiment of FIG. 2, but the present invention is not limited thereto. A voltage supply terminal to which a predetermined reset voltage is applied may be connected to the first terminal of the reset transistor M4.

The first light emission control transistor M5 includes a gate connected with the slight emission control line EMn, a first terminal connected to the second node N2 to which the first terminal of the driving transistor M1 is connected, and a second terminal connected to a source of the first power source voltage ELVDD. The second light emission control transistor M6 includes a gate connected with the light emission control line EMn, a first terminal connected to the third node N3 to which the second terminal of the driving transistor M1 is connected, and a second terminal connected to the anode of the organic light emitting diode OLED. In the exemplary embodiment of FIG. 2, the light emission control transistor includes the first light emission control transistor M5 and the second light emission control transistor M6 respectively connected to the both terminals of the driving transistor M1, but the present invention is not limited thereto. Only one light emission control transistor may be provided.

The first light emission control transistor M5 and the second light emission control transistor M6 receive the light emission control signal EM[n] through the light emission control line EMn and thus simultaneously turned on, and supply the driving current Ioled corresponding to the video data voltage generated from the driving transistor M1 to the organic light emitting diode OLED. By the luminance control method according to the exemplary embodiment, the light emission control signal EM[n] transmitted to the first light emission control transistor M5 and the second light emission control transistor M6 is set by an off duty ratio width calculated by the controller 50. In addition, light emission time of an image displayed in the organic light emitting diode OLED is controlled by controlling on/off of the first and second light emission control transistors M5 and M6 according to the light emission control signal EM[n].

The capacitor Cst includes a first electrode connected to the first node N1 to which the gate of the driving transistor M1 is connected and a second electrode connected to the source of the first power source voltage ELVDD. As described, the first electrode of the capacitor Cst is connected to the first node N1 to which the gate of the driving transistor M1 is connected, and therefore a voltage (Vdata−Vth) corresponding to a difference between the data voltage Vdata applied to the first terminal of the driving transistor M1 and the threshold voltage Vth of the driving transistor M1 is applied through the switching transistor M2 to the first electrode of the capacitor Cst. Meanwhile, the first power source voltage is applied to the source of the first power source voltage ELVDD to the second electrode of the capacitor Cst. Therefore, a voltage difference (ELVDD-Vdata−Vth) between the two electrodes of the capacitor Cst can be stored and the voltage difference can be maintained after the switching transistor M2 is turned off.

The organic light emitting diode OLED includes an anode connected to the second terminal of the second light emission control transistor M6 and a cathode connected to the source of the second power source voltage ELVSS. The organic light emitting diode OLED emits light by changing magnitude of the driving current Ioled that corresponds to the data signal supplied from the driving transistor M1 to thereby display an image.

The transistors shown in FIG. 2 may be p-channel field effect transistors (FETs), but it is not restrictive. At least one of the transistors of FIG. 2 may be an n-channel field effect transistor. In addition, a connection relation between the plurality of transistors M1 to M6, the capacitor Cst, and the organic light emitting diode OLED may be variously modified as long as the circuit element performs the same function.

Figure 3:
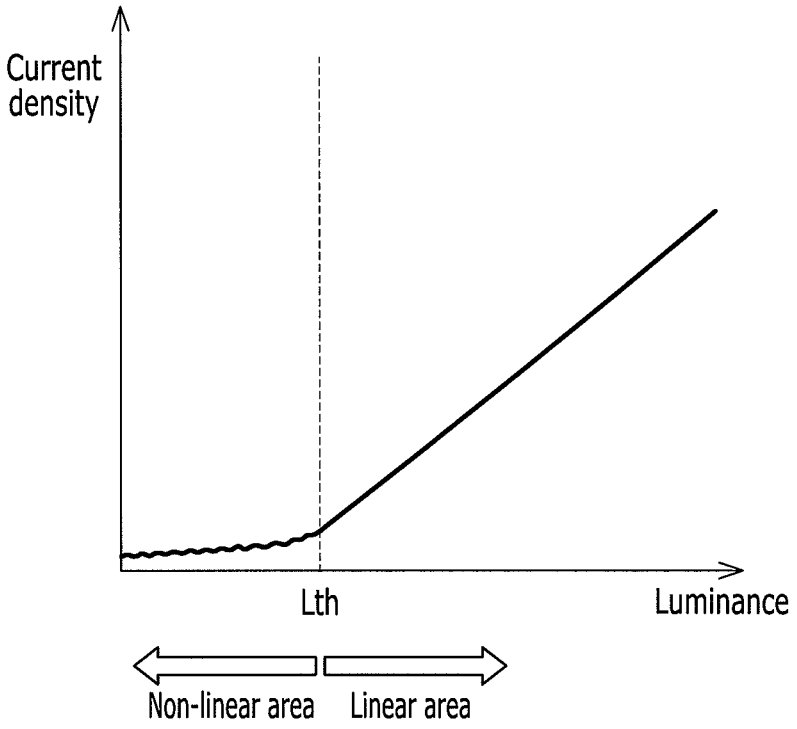
FIG. 3 is a graph illustrating an organic material current density characteristic with respect to luminance of the display device.

FIG. 3 is a graph illustrating an organic material characteristic curved line of current density for each luminance of the display device. In general, an organic light emitting diode emits light in a pixel circuit such as the exemplary embodiment illustrated in FIG. 2 according to a driving current corresponding to a video data signal, and the corresponding driving current is increased as the video data signal includes higher luminance values. FIG. 3 illustrates a driving current amount flowing to the organic light emitting diode of the pixel per unit area according to luminance of an image realized by the display device, and it can be observed that the current density is increased as the luminance is increased. That is, a correlation of the luminance-current density mostly has a linear characteristic. However, a luminance-current density characteristic of the display device is non-linear below a reference luminance Lth due to a characteristic of an organic material of the organic light emitting diode. That is, above the reference luminance Lth is a linear region and an area below the reference luminance Lth is a non-linear region.

As described, in displaying of an image of the display device of which the luminance-current density characteristic is changed with reference to the reference luminance due to the characteristic of the organic material as shown in FIG. 3, application of a uniform luminance control method or application or equal or similar luminance control methods to the entire luminance area may cause problems in an optical characteristic and life-span of a material. Thus, the display device and the driving method for luminance may control according to the exemplary embodiment apply different luminance control methods for the region having a linear luminance-current density characteristic than the region having a non-linear luminance-current density characteristic. The luminance control method for each luminance region will be described in detail with the accompanying drawing.

Figure 4:
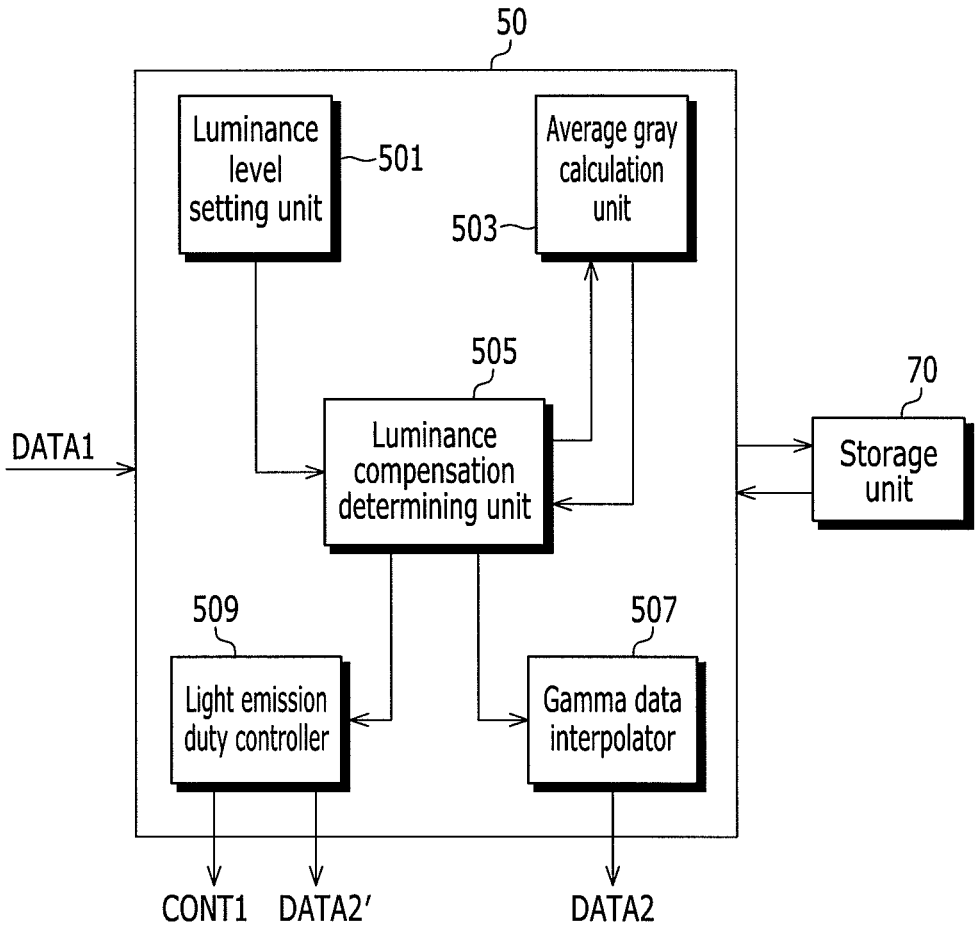
FIG. 4 is a block diagram of a controller 50 of FIG. 1.

FIG. 4 is a block diagram of a controller 50 according to an exemplary embodiment of FIG. 1. Referring to FIG. 4, the controller 50 is formed to differentiate luminance control for each luminance area according to the linear or non-linear characteristic of the luminance-current density, as shown in FIG. 3.

With reference to FIG. 4, a detailed configuration of the controller 50 is described. The controller 50 according to the exemplary embodiment of FIG. 4 receives the video signal DATA1 from an external source and generates a plurality of driving control signals such as video data signals DATA2 and DATA2' converted from the video signal DATA1 and the light emission driving control signal CONT1. FIG. 4 illustrates an output of the light emission driving control signal CONT1 related to luminance control, but the driving control signals transmitted to other drivers as shown in FIG. 1 also can be generated and output.

The controller 50 of FIG. 4 may be connected to the storage unit 70 to perform calculation for luminance control or store output data. In FIG. 4, the storage unit 70 is separately displayed from the controller 50, but the controller 50 may be provided with an internal storage unit. The controller 50 of FIG. 4 includes a luminance level setting unit 501, an average gray level calculator 503, a luminance compensation determining unit 505, a gamma data interpolator 507, and a light emission duty ratio controller 509.

The luminance level setting unit 501 sets a user-desired luminance level and calculates preset gamma data corresponding to the luminance level. Brightness of an image, that is, luminance, has a fixed number of gray levels, e.g., $1024=2^{10}$, $256=2^{8}$, or $64=2^{6}$ gray levels. In general, if a predetermined gray level, for example, the maximum luminance with respect to full-white luminance data in 256 gray levels is 100%, setting of a luminance level with reference to a ratio of the maximum luminance can be determined. The storage unit 70 pre-stores preset gamma data according to a predetermined luminance level without regard to the luminance level set by a user. The controller 50 can acquire preset gamma data according to the luminance level set by the user using pre-stored preset gamma data for each luminance level with the storage unit 70.

Here, the preset gamma data implies gamma data corresponding to several gray levels that become reference for displaying an image by outputting an input video signal to its corresponding data voltage according to a luminance level from the data driver. If a total gray level range is 256 gray levels, preset gamma data outputting a data voltage corresponding to 255 gray levels may be displayed as V255 and preset gamma data such as V197, V63, V31, and V5 may be set as a preset gamma data group according to a predetermined luminance level.

A luminance level setting method of a user may not be limited to a specific method, and the user may directly input luminance level information according to an exemplary embodiment. The luminance level set by the user in the luminance level setting unit 501 is calculated as a plurality of preset gamma data corresponding thereof to compensate the video data signal.

According to the luminance control driving method according to the exemplary embodiment, a luminance control method may be primarily determined according to the luminance level set through the luminance level setting unit 501. That is, information on the luminance level set by the user, input to the luminance level setting unit 501 is transmitted to the luminance compensation determining unit 505 to determine a luminance control method. The luminance compensation determining unit 505 receives information on the luminance level set by the user and compares the luminance level with a predetermined reference luminance level LLref to determine a luminance control method.

If the luminance level set by the user is less than the reference luminance level LLref, a luminance control method (hereinafter, an AID method) performed by the luminance duty ratio controller 509 may be applied, and if the luminance level is greater than the reference luminance level LLref, a luminance control method (hereinafter, a GI method) performed by the gamma data interpolator 507 may be applied. However, if the luminance level is higher than the reference luminance level LLref, a luminance control method can be secondarily determined after an average gray level calculation process performed in the luminance compensation determining unit 505 rather than determining the luminance control using the GI method.

Here, the AID method is a method in that luminance is controlled using a light emission control method through duty ratio control of a light emission control signal transmitted to the pixel of FIG. 2. In other words, a duty ratio is controlled by calculating an off pulse width of the light emission control signal to control a light emission time and a light emission amount of the pixel such that luminance can be controlled.

In addition, the GI method controls luminance by compensating a data signal through gamma control of video data. That is, luminance can be controlled by calculating preset gamma data and compensating a video data signal using the preset gamma data.

When determining that the luminance compensation determining unit 505 controls luminance using the GI method, the luminance level setting unit 501 acquires a plurality of preset gamma data according to the luminance level set by the user. However, the plurality of preset gamma data according to the luminance level set by the user may also be acquired by the luminance compensation determining unit 505 or the gamma data interpolator 507.

A method for acquiring preset gamma data according to a predetermined luminance level in the luminance level setting unit 501 is not limited to any method, but an interpolation method using a preset gamma data group according to a predetermined reference luminance level stored in the storage unit 70 may be used. For example, if a preset gamma data group is pre-stored with a 10% luminance level gap such as reference luminance level of 100%, 90%, 80%, and 70% in the storage unit 70 and the user set the luminance level of 85% through the luminance level setting unit 501, the luminance compensation determining unit 505 determines a luminance control method according to the luminance level of 85% by comparing and determining information on the luminance level set by the user, transmitted from the luminance level setting unit 501 and the reference luminance level LLref. If the reference luminance level LLref is set to 20%, a luminance control method, that is, the AID method or the GI method may be determined again through a process performed in the average gray level calculation unit 503 because the luminance level set by the user is too high. If the luminance level set by the user is lower than the reference luminance level LLref, that is, 20%, the luminance may be controlled using the AID method.

In the above example, the luminance control method is secondarily determined because the luminance level set by the user is higher than the reference luminance level LLref, and the luminance level setting unit 501 calculates a preset gamma data group for the luminance level of 85% set by the user. In this case, upper and lower preset gamma data groups that are close to the luminance level set by the user among luminance level-specific the preset gamma data groups stored in the storage unit 70. That is, preset gamma data corresponding to 85% is acquired using preset gamma data groups, respectively corresponding to 80% and 90%.

Meanwhile, the average gray level calculation unit 503 receives an external video data DATA1 and calculates average gray level data for each frame.

As described above, if the luminance level set by the user in the luminance level setting unit 501 is determined to be higher than the predetermined reference luminance level LLref by the luminance compensation determining unit 505, the average gray level calculation unit 503 calculates an average gray level for each frame to determine a secondary luminance control method.

The calculated average gray level data is transmitted to the luminance compensation determining unit 505 and the luminance control method can be determined by determining with reference to the predetermined reference gray level Gth. That is, if the calculated average gray level data is higher than the reference gray level Gth, the GI method is used to control luminance, and if the calculated average gray level is lower than the reference gray level Gth, the AID method for controlling an off duty ratio of the light emission control is used to control luminance.

A method of calculating average gray level data for the external video signal DATA1 in the average gray level calculation unit 503 is not limited to any specific method.

Figure 5:
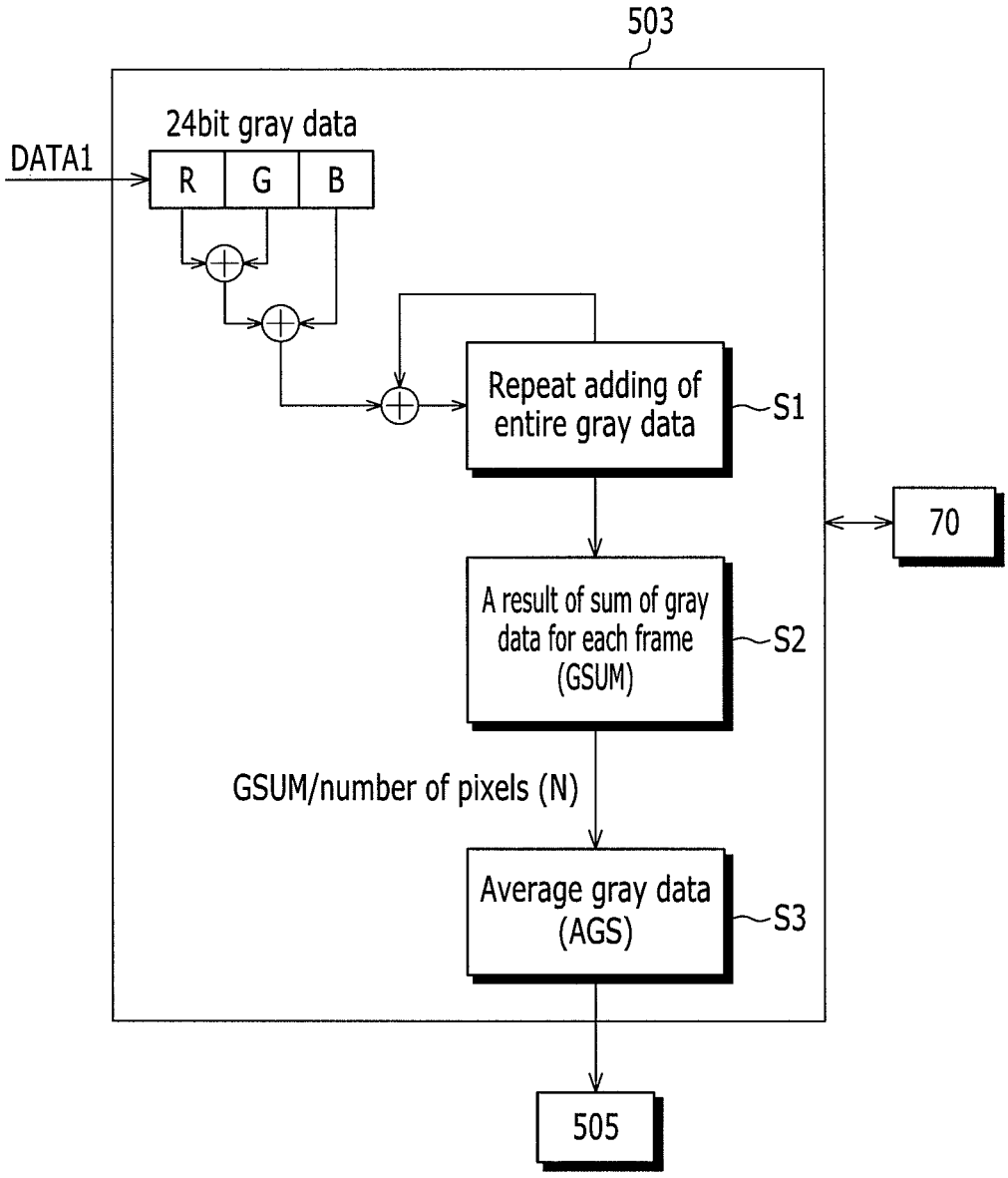
FIG. 5 is a flowchart illustrating a process for calculating average gray level data in the average gray level calculation unit 503 of FIG. 4 in detail.

As a method for calculation of the average gray level data, an average value can, for example, be acquired from a total of luminance data Y from a YCbCr color. That is, a luminance value Y is operated using basic primary color RGB signal data in video data signal DATA1 and an organic material characteristic for each frame and the average value can be acquired from a total of the luminance values. Alternatively, average gray level data can be acquired by dividing a total of basic primary RGB pixel data in video data signal DATA1 for each frame with the number of pixels. FIG. 5 shows a process for calculating the average gray level data in the average gray level calculation unit 503 according to such a method in detail.

Referring to FIG. 5, the average gray level calculation unit 503 receives an average gray level calculation command for determination of a secondary luminance control method from the luminance compensation determining unit 505, and adds 24 bits RGB data formed of 8 bits for each frame from the external video signal DATA1. Adding of the entire gray levels is repeated S1. According to another exemplary embodiment, valid data higher than predetermined luminance is extracted and then added rather than adding all the RGB pixel data of the entire image. Then, gray level data sum result GSUM for each frame is calculated (S2). The sum result is divided by the number of pixels N to calculate average gray level data (AGS=GSUM/N) (S3). Information calculated through such a process can be transmitted to the storage unit 70 and the stored therein. The average gray level data AGS calculated in step S3 is transmitted back to the luminance compensation determining unit 505 and then used for determining a luminance control method.

Figure 6:
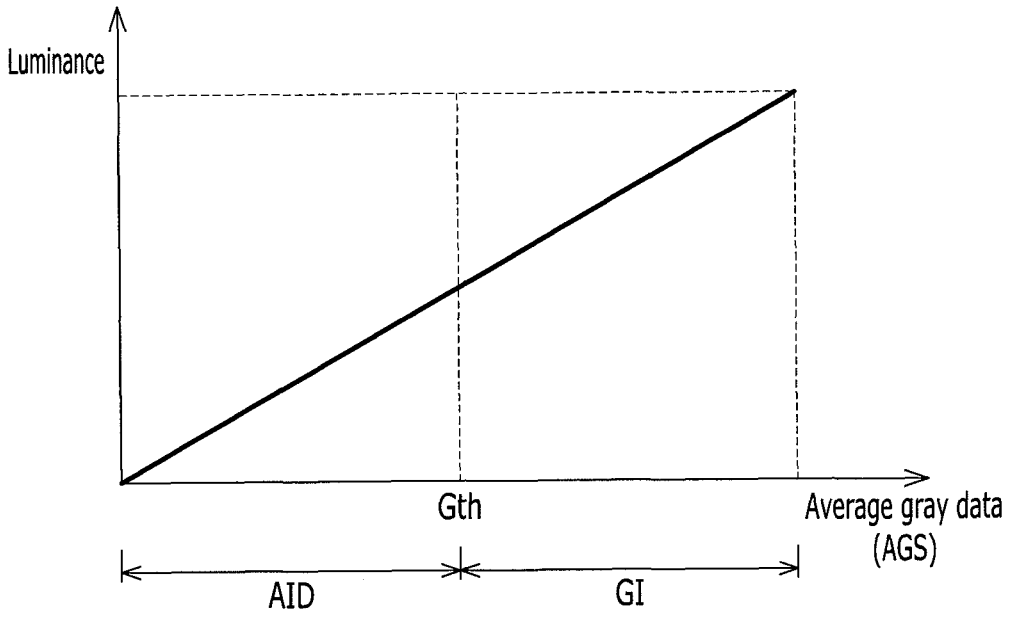
FIG. 6 is a graph illustrating a method for determining a luminance compensation method of the display device in the luminance compensation determining unit 505 of FIG. 4.

The graph of FIG. 6 illustrates a concept for determination of a luminance compensation method of the display in the luminance compensation determining unit 505, and the luminance compensation determining unit 505 can determine a method for controlling luminance by receiving the average gray level data AGS calculated by the average gray level calculation unit 503 and comparing the received average gray level data AGS with the predetermined reference gray level Gth. As described above, the luminance compensation determining unit 505 can primarily determine a luminance control method with respect to a luminance level set by the user and then secondarily determine a luminance control method using the average gray level data AGS.

As shown in the graph of FIG. 6, if the average gray level data AGS is greater than the reference gray level Gth, a gamma data interpolation method may be determined to be applied, and if the average gray level data AGS is smaller than the reference gray level Gth, a method for controlling duty ratio of the light emission control signal may be determined to be applied.

Referring to the controller 50 of FIG. 4, a configuration unit is modified according to the luminance control method determined by the luminance compensation determining unit 505. That is, if it is determined to apply the gamma data interpolation (GI) method, the gamma data interpolator 507 is activated to perform a function for luminance control. If it is determined to apply the method for controlling duty ratio (AID) of the light emission control signal, the light emission duty ratio controller 509 is activated to perform a function for luminance control.

Figure 7:
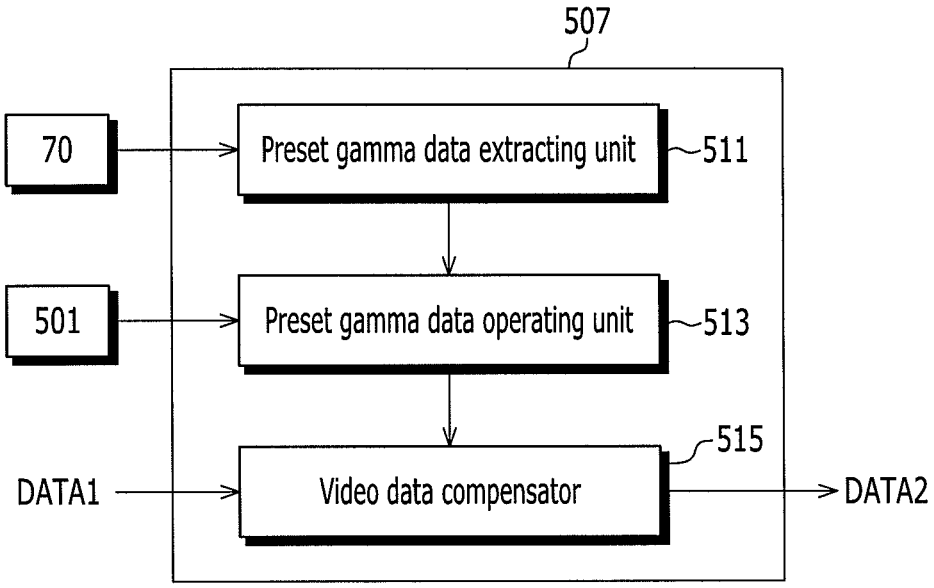
FIG. 7 is a block diagram of a configuration of the gamma data interpolator 507 of FIG. 4.

FIG. 7 shows a block diagram of configuration of the gamma data interpolator 507 included in the controller 50 of FIG. 4. Referring to FIG. 7, the gamma data interpolator 507 may be formed of a preset gamma data extracting unit 511, a preset gamma data operating unit 513, and a video data compensator 515. However, the configuration of FIG. 7 is only one of exemplary embodiments, and thus it may be variously modified within a range of performing a function to compensate luminance using the gamma data interpolation method of FIG. 7.

The preset gamma data extracting unit 511 extracts preset gamma data with respect to a luminance level referred to a luminance level for operation of preset gamma data for the luminance level set through the luminance level setting unit 501 from the storage unit 70. That is, upper and lower luminance levels that are most close to the predetermined luminance level are selected and preset gamma data groups corresponding thereto may be extracted.

The extracted preset gamma data groups for reference are transmitted to the preset gamma data operating unit 513 and used for operation of preset gamma data with respect to the luminance level set in the luminance level setting unit 501. Operation equation is not limited to anyone, and a new preset gamma data group for the luminance level may be calculated corresponding to the preset gamma data group for reference.

The preset gamma data extracting unit 511 and the preset gamma data operating unit 513 performing the above-described functions may be provided in the gamma data interpolator 507 rather than being provided in the luminance level setting unit 501.

The video data compensator 515 generates a video data signal DATA2 converted corresponding to a luminance level from the external video signal DATA1 and outputs the video data signal DATA2 using the preset gamma data with respect to the corresponding luminance level calculated from the preset gamma data operating unit 513. Since preset gamma data for a luminance level set by the user is gradually increased as the luminance level set by the user is gradually decreased with respect to the maximum luminance level 100%, the video data signal DATA2 also converted corresponding thereto.

The video data signal DATA2 is a data signal compensated by modulating an initial input signal corresponding to the luminance level set by the user, and therefore an image display with a data voltage according to the video data signal DATA2 is controlled according to the luminance level set by the user.

Figure 8:
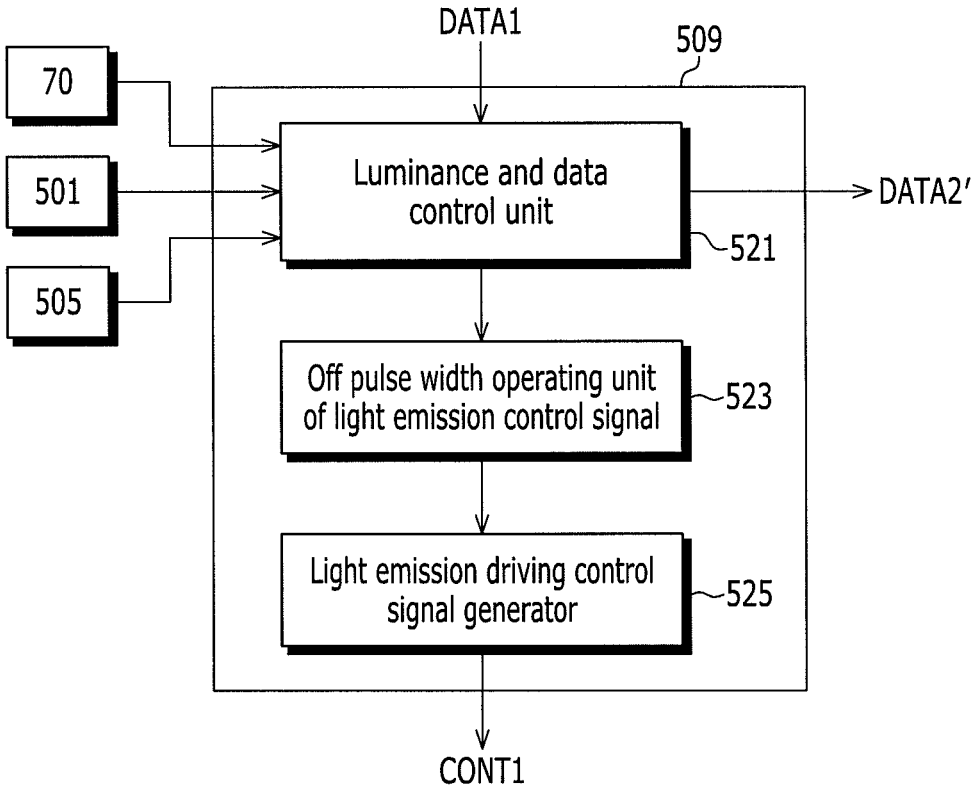
FIG. 8 is a block diagram of a configuration of the light emission duty ratio controller 509 of FIG. 4.

FIG. 8 is a block diagram illustrating a configuration of the light emission duty ratio controller 509 included in the controller 50 of FIG. 4. The light emission duty ratio controller 509 of FIG. 8 includes a luminance and data control unit 521, an off pulse width operation unit 523 of a light emission control signal 523, and a light emission driving control signal generator 525. The configuration of FIG. 8 is only one of exemplary embodiments, and therefore it may be variously modified within a range of performing a function to compensate luminance using the light emission duty ratio control method of FIG. 8.

The light emission duty ratio controller 509 may be activated if the AID method is determined to be used for controlling luminance by the luminance compensation determining unit 505. The light emission duty ratio controller 509 controls luminance by controlling a light emission time and a light emission amount of each pixel of the display unit by a luminance difference while processing luminance higher than luminance information included in the external video signal DATA1 to be displayed. In order to perform such a function, the video data signal DATA2' may be output by converting gray level data of the original video signal DATA1. In addition, if displaying an image, the light emission driving control signal CONT1 that controls an off duty ratio and a driving timing of the light emission control signal to control a light emission time and a light emission amount of the display may be generated and output. Here, unlike the video data signal DATA2 output from the gamma data interpolator 507, the output video data signal DATA2' is not converted by compensating the external video data but modulated to express higher luminance than luminance of the organic video data.

Various methods may be used to process a data signal to express higher luminance than original data luminance information before the light emission duty ratio controller 509 controls the off duty ratio of the light emission control signal f the light emission duty ratio controller 509, and the various methods include the following two methods.

A first method is to change a preset gamma data group using a luminance level-specific preset gamma data stored in the storage unit 70. In this case, a luminance level set by a user is ignored and the preset gamma data group stored in the storage unit is used to correspond to a higher luminance level than the corresponding luminance level, and therefore the image is displayed with higher luminance than the luminance information included in the originally input video data. Thus, luminance is controlled for light emission according to the luminance information included in the origin video data by controlling the light emission time and the light emission amount.

Figure 9:
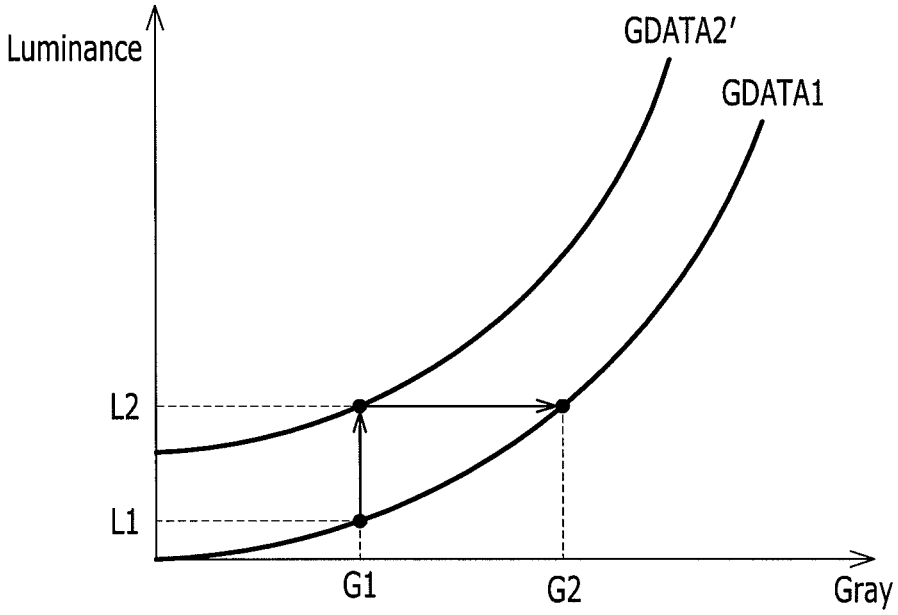
FIG. 9 is a graph illustrating a method for controlling a duty ratio of the light emission control signal in the light emission duty ratio controller 509 of FIG. 8.

A second method is to control gray level data of the origin video signal as shown in the graph that schematically illustrating a concept of controlling a duty ratio of the light emission control signal, and output the controlled gray level data. FIG. 9 is a gamma curve representing a luminance characteristic of gray level data of a video signal, and GDATA1 indicates a gamma curve of luminance with respect to gray level data included in an original external video signal and GDATA2 indicates another gamma curve raised toward a luminance axis (i.e., the y axis) from the corresponding gamma curve. The video data signal. DATA2' is generated by modulating gray level data with respect to the external video signal DATA1 using the gamma curve GDATA2 rained by a predetermined luminance value (L2-L1) from the gamma curve GDATA1 of the original video data DATA1. In further detail, gray level data representing luminance L1 among luminance information of the video data is. G1 if using the original gamma curve GDATA1, and gray level data representing luminance L2 that is greater than the luminance L1 is G2 if using the gamma curve GDATA2' that is raised by the predetermined luminance value (L2-L1). Thus, the video data signal DATA2' controlled as the gray level data G2 is generated and output to display an image, and a duty ratio of the light emission control signal is controlled to compensate luminance increased by the luminance value.

The luminance and data control unit 521 included in the light emission duty ratio controller 509 is a means for performing the first and second method before calculation of the off duty ratio of the light emission control signal as described above. FIG. 8 illustrates that both of the first and second methods can be realized for better understanding and ease of description, but the present invention is not limited thereto. That is, the luminance and data control unit 521 may be able to control luminance using the first method or may control luminance by converting the gray level data according to the second method. Alternatively, the luminance may be controlled simultaneously using the first and second methods as shown in FIG. 8.

If the luminance is controlled using the first method, the luminance and data control unit 521 of FIG. 8 receives the external video signal DATA1 and generates a video signal according to a driving method of the display device and outputs the video signal. In addition, the luminance and data control unit 521 acquires preset gamma data group information corresponding to a luminance level that is higher than the luminance level set in the luminance level setting unit 501 from the storage unit 70, and displays an image by outputting a data voltage corresponding to the video data signal using the acquired preset gamma data group.

Meanwhile, if the luminance is controlled using the second method, the luminance and data control unit 521 of FIG. 8 receives the external video signal DATA1, and generates the video data signal DATA2' of which gray level data is changed using the gamma curve raised by a predetermined luminance value from the original gamma curve and output the video data signal DATA'.

The off pulse width operation unit 523 of the light emission control signal calculates an off duty ratio of the light emission control signal to control a light emission time and a light emission amount corresponding to displaying of an image of which luminance is controlled according to the first or second method.

That is, if the preset gamma data is changed or gray level data is controlled to output an image with luminance higher by 10 than luminance information of the original video signal, luminance should be decreased by about 10 by increasing the off pulse width of the light emission control signal by a predetermined period so as to display the image with the luminance of the original video signal. The off pulse width operation unit 523 of the light emission control signal is a means for calculating such an off pulse width. Calculation of the off pulse width of the light emission control signal is not limited to any Equation, and it may be represented by Equation 1.

$$AID_OFF_TAR = AID_OFF_DUR + (MAXNL - AID_OFF_DUR) * 0.1 \quad \text{Equation 1}$$

where, AID_OFF_TAR denotes a target value of an off pulse width of a light emission control signal, AID_OFF_DUR denotes an off pulse width of a current light emission control signal, and MAXNL denotes an off pulse width (including an active and blank periods) of the entire light emission control signal.

As shown in Equation 1, information of an off pulse width of the light emission control signal, calculated by the off pulse width operation unit 523 of the light emission control signal is transmitted to a light emission driving control signal generator 525. Then, the light emission driving control signal generator 525 generates the light emission driving control signal CONT1 and transmits the signal to the light emission control driver 40 to control the light emission control driver 40 to generate a light emission control signal having the off pulse width.

The light emission control driver 40 received the light emission driving control signal CONT1 generates a light emission control signal having the calculated off pulse width and transmits the light emission control signal to each pixel of the display such that an image can be displayed with luminance corresponding to an original video signal.

Figure 10:
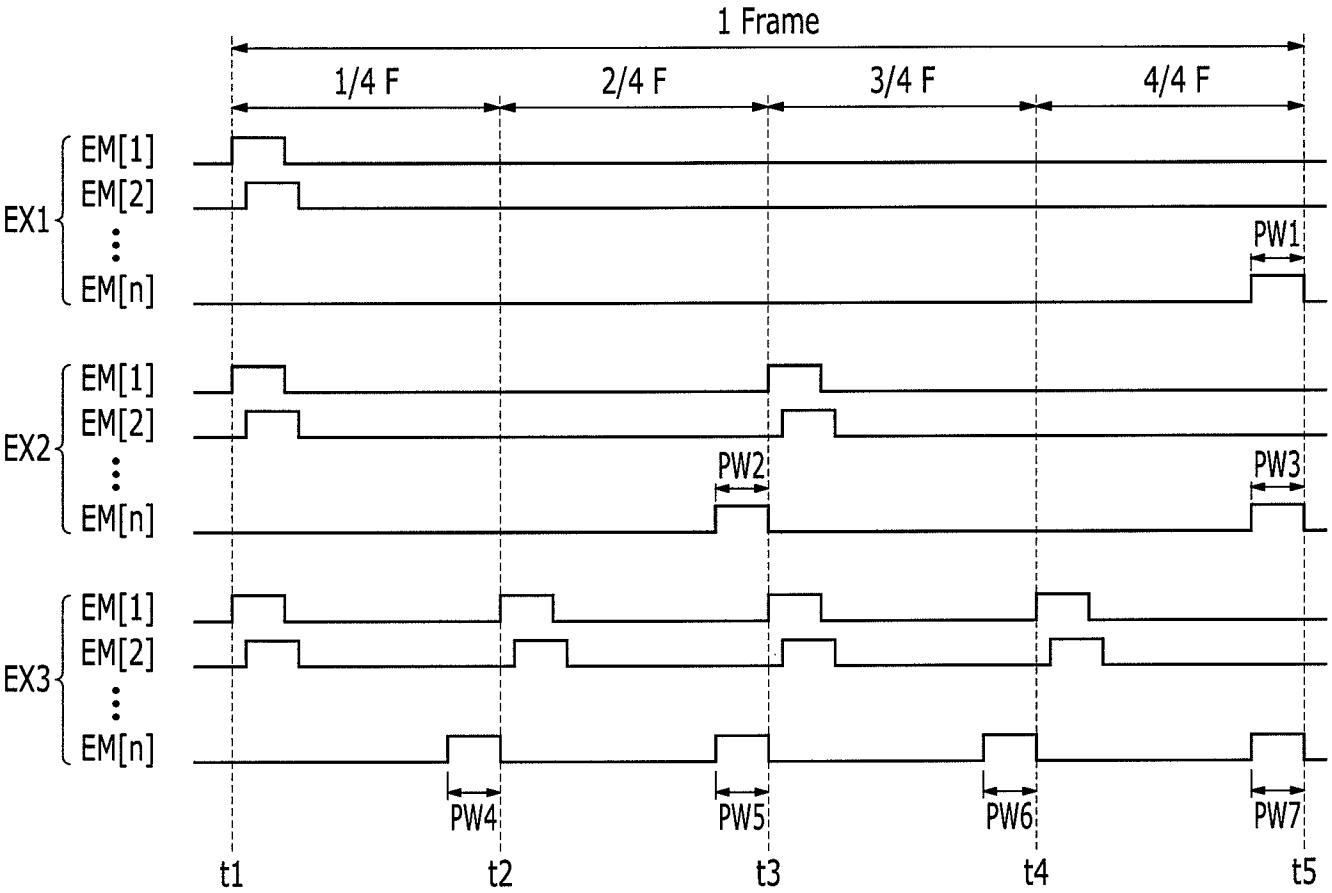
FIG. 10 is a timing diagram illustrating an embodiment for controlling a duty ratio of the light emission control signal in the light emission duty ratio controller 509 of FIG. 8.

FIG. 10 is a timing diagram illustrating exemplary embodiments for controlling a duty ratio of a light emission control signal in the light emission duty ratio controller 509 according to the exemplary embodiment of FIG. 8. In FIG. 10, the exemplary embodiments EX1, EX2, and EX3 of the light emission control signal may have the off pulse width calculated by the off pulse width operation unit 523 according to a command of the light emission driving control signal CONT1 generated by the light emission driving control signal generator 525.

Referring FIG. 10, light emission control signals EM[1] to EM[n] transmitted all the pixels the display unit for each frame are illustrated. Since the transistors of the pixels are realized as PMOS transistors in the pixel circuit of FIG. 2, if the light emission control signal is transmitted as a low level pulse, the pixels emit light and thus an image is displayed, and if the light emission control signal is transmitted as a high level pulse, light emission of the pixels are blocked.

In the exemplary embodiment EX1 of FIG. 10, a light emission off period having a predetermined off pulse width exist only once in each of the light emission control signals EM[1] to −EM[n]. If the off pulse width calculated by the light emission duty ratio controller 509 is greater than a predetermined period (e.g., a period PW1 in FIG. 10), a light emission off period may be divided as shown in the exemplary embodiments EX2 and EX3. In the exemplary embodiment EX2, the off pulse width is two times larger than that of PW1, and thus each of the light emission control signals EM[1] to EM[n] has two light emission off periods PW2 and PW3 for each frame. In addition, in the exemplary embodiment EX3, the off pulse width is four times larger than that of PW1, and thus each of the light emission control signals EM[1] to EM[n] has four light emission off periods PW4 to PW7 for each frame. If the light emission off period is realized by dividing several periods for each frame, visual recognition of blocking of light emission can be prevented so that an image can be naturally displayed.

Figure 11:
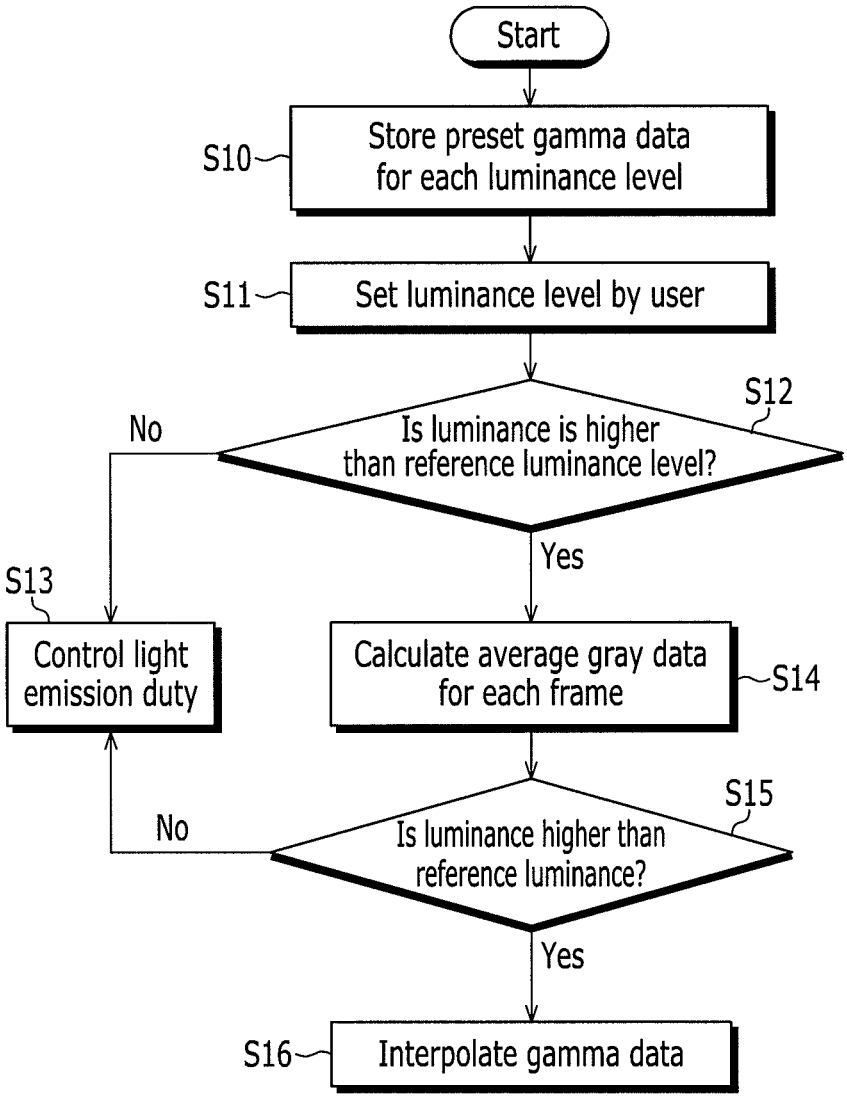
FIG. 11 is a flowchart illustrating a driving method of the display device according to an exemplary embodiment.
Figure 12:
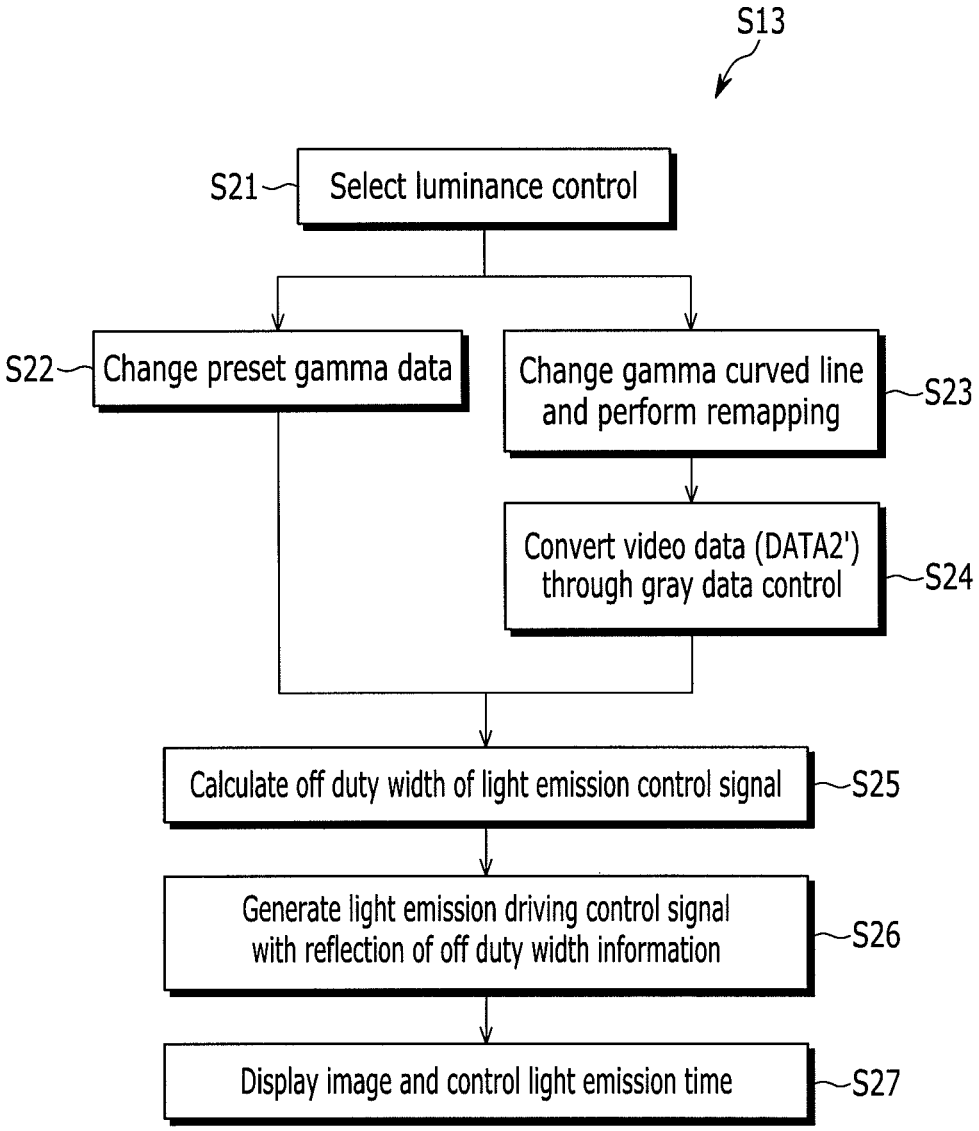
FIG. 12 is a flowchart illustrating a light emission duty ratio control step S13 according to the embodiment of FIG. 11.

FIG. 11 is a flowchart of a driving method of the display device according to an exemplary embodiment. FIG. 12 is a flowchart illustrating a light emission duty ratio control step S13 in the flowchart of FIG. 11 in detail.

Referring to FIG. 11, preset gamma data of each luminance level is stored in the storage unit (S10). The preset gamma data may be provided in plural with a predetermined gap for the corresponding luminance level and stored. In addition, if the gamma data interpolation method is applied, the preset gamma data may be applied to an equation to acquire preset gamma data for a luminance level set by a user. If the preset gamma data is stored for each luminance level, a gap between the respective reference luminance levels may be constant.

A user sets a luminance level through the luminance level setting unit 501 (S11). If the luminance level set by the user is the same as the reference luminance level stored in the step S10, an image can be displayed using a preset gamma data group according to the corresponding luminance level, stored in the storage unit without performing an additional process. However, if the luminance level set by the user is different from the reference luminance level stored in the step S10, preset gamma data can be operated using an interpolation method according to a luminance control method through the following process.

It is determined whether the luminance level set by the user in the step S11 is higher than a reference luminance level LLref in step S12. In this case, the luminance determination in the step S12 is primary determination. The reference luminance level LLref may be predetermined according to specification of the display device. If it is determined that the luminance level set by the user is higher than the reference luminance level LLref, step S14 is performed. Otherwise, step S13 is performed.

The step S13 and the step S14 respectively relate to individual luminance control methods, and the step S13 relates to an AID method in which luminance is controlled by controlling an off duty ratio of the light emission control signal as shown in FIG. 12 because the set luminance level is lower than the reference luminance level.

After the step S14, a luminance control method is determined by performing the secondary luminance determining process again. That is, if the luminance level set by the user is determined to be higher than the reference luminance level LLref, average gray level data for each frame is calculated (S14). A method for calculating the average gray level data has already been described in description of the average gray level calculation unit 503 of FIG. 4, and may be used in step S14.

Whether the calculated average gray level data is higher than a reference gray level (Gth) is determined through comparison therebetween (S15). The process in the step S15 corresponds to the secondary determination for determining a luminance control method. In this case, the reference gray level Gth is a gray level data voltage corresponding to predetermined luminance. The predetermined luminance and the reference gray level Gth corresponding thereto also can be pre-determined according to specification of the display device.

The comparison with the pre-set reference luminance in the steps S12 and S13 is performed for natural luminance control by controlling luminance for a low gray level area and for a high gray level area in display of an image in the display device because a luminance-current density characteristic has a non-linear characteristic in the low gray level area due to a characteristic of an organic material.

If it is determined that the average gray level data is higher than the reference gray level Gth in the step S15, the step S16 is performed. Otherwise, the step S13 is performed. That is, since the calculated average gray level data is lower than the reference gray level Gth, luminance is controlled using the AID method of the step S13.

In addition, if it is determined that the calculated average gray level data is higher than the reference gray level Gth, the luminance is controlled using the gamma data interpolation method, that is, the GI method of the step S16. That is, a preset gamma data group corresponds to the luminance level set by the user in the step S11 is calculated through the interpolation method using luminance-specific preset gamma data groups pre-stored in the storage unit and a video data signal is compensated using the calculated preset gamma data to thereby display an image.

If the luminance is controlled using the AID method, stress of the organic material is increased as compared to driving of an existing display device due to input of gamma data corresponding higher luminance than a low luminance area so that the life-span of the organic light emitting element may be deteriorated. Thus, the driving method for luminance control of the display device according to the exemplary embodiment applies the AID method to a predetermined low gray level area, and selects the GI method to compensate a video data signal using preset gamma data calculated using the gamma data interpolation method in a high gray level area, that is, an area of which a luminance-current density characteristic is linear to thereby prevent life-span deterioration of the organic light emitting element.

A process for controlling luminance using the AID is illustrated in further detail in the flowchart of FIG. 12. If it is determined to be included in a low gray level area, that is, a luminance area having a non-linear luminance-current density characteristic, the AID method is selected to perform luminance control for light emission duty ratio control in step S21. Here, the luminance control for the light emission duty ratio control implies a video data voltage output through the data driver of the display device to be output with higher luminance than luminance information included in a substantially input video signal. In the step S21, such a luminance control method is selected.

Through the process for selecting a luminance control method, the step S22 or the steps S23 and S24 may be respectively performed. In the step S22, a preset gamma data group is acquired not by calculating preset gamma data corresponding to the luminance level set by the user but by changing luminance to a higher luminance level by predetermined luminance. That is, an image having high luminance can be output by changing a preset gamma data group rather than modulating gray level data representing luminance information included in an input video signal.

A gamma curve is changed and gray level data representing the luminance information included in the input video signal is remapped using the changed gamma curve (S23). A video data signal is converted by modulating the entire gray level data included in one frame through the changed gamma curve (S24). Then, the output image has higher luminance than the input video signal due to the modulated gray level data.

Detailed processes of the steps S22, S23, and S24 may be similar to those described above. In order to reduce an image output with luminance controlled to be higher than the luminance information included in the original video signal through the steps S22, S23, S24 to the original luminance level, an off duty ratio width of the light emission control signal controlling a light emission time and a light emission amount of the organic light emitting diode is calculated in step S25.

That is, if the off pulse width of the light emission control signal is increased by the luminance controlled to be higher due to change of a preset gamma data group or modulated gray level data corresponding to a changed gamma curve, the light emission time and the light emission amount can be reduced so that the luminance that is equal to the original luminance information can be expressed. If the off duty ratio width of the light emission control signal is calculated in the step S25, the controller generates a light emission driving control signal transmitted to the light emission control driver and includes the off duty ratio width information in the generated signal (S26).

Then, the display device displays an image by emitting light with a driving current corresponding to a video data signal according to the luminance controlled to be higher than luminance information of the original video signal (S27). In this case, the light emission control driver generates a light emission control signal having the calculated off pulse width according to the light emission driving control signal to control a light emission off time of each of the pixels included in the display unit. Then, a light emission time and the light emission amount for a displayed image of each pixel for each frame can be controlled (S27). That is, the light emission off period is extended by increased luminance so that the light emission time and the light emission amount are decreased.

Unlike the GI method controlling luminance by controlling gamma data of an input signal, the AID method according to the exemplary embodiment of FIG. 12 controls luminance by controlling an off pulse width of the light emission control signal so that luminance can be controlled without regard to an organic material of the display and a color shift problem due to characteristic deterioration of the organic material can be solved.

The drawings and the detailed description described above show exemplary embodiments. Therefore, it is understood that various modifications and other embodiments may be practiced by those who are skilled in the art. Those skilled in the art can omit some of the constituent elements described in the present specification without deterioration in performance thereof or can add elements to improve performance thereof. Further, those skilled in the art can modify the sequence of the steps of the method described in the present specification depending on the process environment or equipment. Therefore, the scope of the present invention is not limited to the described exemplary embodiments.

What is claimed is:

1. A method of controlling luminance of a display device including a display unit having a plurality of pixels emitting light with a driving current corresponding to video data during a light emission period according to a light emission control signal transmitted through a plurality of light emission control lines, the method comprising:

receiving a luminance level from a user;

applying a first luminance control method if the received luminance level is less than a reference luminance level;

calculating an average value of video data for each frame if the luminance level is greater than the reference luminance level;

applying the first luminance control method if the average value is less than a reference gray level value; and applying a second luminance control method if the average value is greater than the reference gray level value, wherein the reference luminance level is a luminance level corresponding to a boundary that separates a linear characteristic and a non-linear characteristic in luminance-current density relationships based on an organic material characteristic of the pixels.

2. The luminance control method of the display device of claim 1, wherein the first luminance control method includes controlling a light emission period of the pixel by controlling a light emission off duty ratio of the light emission control signal.

3. The luminance control method of claim 1, wherein the second luminance control method includes controlling luminance by calculating a gamma data group including a plurality of gamma data corresponding to the received luminance level and converting the external video signal to a video data signal using the gamma data group.

4. The luminance control method of the display device of claim 1, further comprising, before the receiving the luminance level, pre-storing a reference luminance level and a preset gamma data group corresponding to the reference luminance level to calculate a gamma data group including a plurality of preset gamma data corresponding to the luminance level.

5. The luminance control method of the display device of claim 1, wherein the luminance level is a percentage of relative brightness with respect to maximum luminance for full-white luminance data in the video data.

6. The luminance control method of claim 1, wherein the reference gray level value is a gray level data value corresponding to a boundary that separates a linear characteristic and a non-linear characteristic in luminance-current density relationships based on an organic material characteristic of the pixel.

7. The luminance control method of claim 1, wherein the first luminance control method comprises:

controlling luminance to be higher luminance than luminance information included in the video data;

calculating an off pulse width of the light emission control signal corresponding to a luminance value increased due to the luminance control;

generating a light emission driving control signal corresponding to the calculated off pulse; and displaying an image corresponding to the controlled luminance and controlling a light emission period of the image according to the light emission driving control signal.

8. The luminance control method of the display device of claim 7, wherein the light emission control signal comprises a light emission block period corresponding to the calculated off pulse width, and the light emission block period includes at least two periods if the off pulse width is greater than a predetermined width.

9. The luminance control method of the display device of claim 7, wherein the controlling of the luminance is selected from one of:

controlling the luminance to a greater luminance by changing a preset gamma data group to convert the external video signal, and controlling the luminance to a greater luminance by modulating gray data of the external video signal using a changed gamma curve that is changed from a gamma curve corresponding to the video data.

10. The luminance control method of the display device of claim 1, wherein the second luminance control method comprises:

calculating a preset gamma data group corresponding to the received luminance level by interpolating preset gamma data groups respectively corresponding to greater and lesser luminance levels than the received luminance level; and compensating the luminance to the received luminance level by converting the video data using the preset gamma data group corresponding to the received luminance level.

11. The luminance control method of the display device of claim 1, wherein the calculating the average value of the gray data is selected from one of:

calculating an average value from a total of luminance data Y for each frame in a YCbCr color, and calculating an average value by dividing a total of basic primary color (R, G, and B) pixel data of the external video signal for each frame by the number of pixels.

12. The luminance control method of the display device of claim 11, wherein the total of the basic primary color pixel data is a total of valid pixel data greater than a predetermined luminance.

13. A display device, comprising:

a display unit including a plurality of pixels respectively connected to a plurality of scan lines, a plurality of light emission control lines, and a plurality of data lines and emitting light with a driving current during a light emission period according to a light emission control signal transmitted through the light emission control line; and a controller configured to determine a luminance control method by:

comparing a luminance level received from a user with a reference luminance level;

applying a first luminance control method if the received luminance level is less than a reference luminance level; and when the received luminance level is greater than the reference luminance level, determining whether to apply the first luminance control method or a second luminance control method by: i) calculating an average value of gray level data included in video data for each frame and ii) comparing the average value with a predetermined reference gray value level, wherein the controller comprises a luminance compensation determining unit configured to determine whether to apply the first or second luminance control method, and wherein the luminance compensation determining unit is configured to pre-set the reference luminance level and the reference gray corresponding to a boundary that separates a linear characteristic and a non-linear characteristic in luminance-current density relationships according to an organic material characteristic of a pixel and determine a luminance control method using the reference luminance level and the reference gray.

14. The display device of claim 13, wherein the determined luminance control method includes applying the first luminance control method if the luminance level is less than the reference luminance level, and applying the second luminance control method if the received luminance level is greater than the reference luminance level.

15. The display device of claim 14, wherein the second method includes applying the first luminance control method if the average value is less than a predetermined reference gray level value and apply a second luminance control method if the average value is greater than the reference gray level value.

16. The display device of claim 13, wherein the controller comprises:

a luminance level setting unit configured to receive the luminance level from the user;

an average gray calculator configured to calculate the average value;

a light emission duty ratio controller configured to control a light emission period of the pixels by controlling a light emission off duty ratio of the light emission control signal according to determination of the luminance compensation determining unit; and a gamma data interpolator configured to control luminance to be the received luminance by calculating a gamma data group including a plurality of preset gamma data corresponding to the received luminance level according to determination of the luminance compensation determining unit and converting the video data to a video data signal using the gamma data group, wherein the luminance compensation determining unit is configured to determine whether to apply the first or second luminance control method by respectively comparing the received luminance level and the average value of the gray data with the reference luminance level and the reference gray level value.

17. The display device of claim 16, wherein the controller further comprises a storage unit pre-storing a reference luminance level and a preset gamma data group corresponding to the reference luminance level to calculate a gamma data group corresponding to the luminance level received from the user.

18. The display device of claim 16, wherein the luminance level setting unit inputs the luminance level with a percentage of relative brightness with respect to maximum luminance of full-white luminance data in the video data.

19. The display device of claim 16, wherein the average gray calculator is configured to calculate the average value from a total of luminance data Y for each frame in YCbCr color and to calculate an average value by dividing a total of basic primary colors (R, G, and B) pixel data of the external video signal for each frame by the number of pixels.

20. The display device of claim 16, wherein the light emission duty ratio controller comprises:

a control unit configured to control luminance to be higher luminance than luminance information included in the video data;

an operating unit configured to calculate an off pulse width of the light emission control signal corresponding to a luminance value increased due to the luminance control; and a control signal generator configured to generate a light emission driving control signal according to off pulse width information.

21. The display device of claim 20, wherein the light emission driving control signal comprises a command for dividing a light emission block period of the light emission control signal into at least two periods if the calculated off pulse width is greater than a predetermined width.

22. The display device of claim 20, wherein the control unit controls luminance to be greater luminance by changing a preset gamma data group for converting the external video signal or controlling luminance to be greater luminance by modulating gray data of the external video signal using a changed gamma curve changed from a gamma curve corresponding to the external video signal.

23. The display device of claim 16, wherein the gamma data interpolator comprises:

an extracting unit configured to transmit preset gamma data groups respectively corresponding to greater and lesser luminance levels than the received luminance level;

an operating unit configured to calculate a preset gamma data group corresponding to the received luminance level by interpolating the preset gamma data group; and a video data compensator configured to compensate luminance with the received luminance level by converting the external video signal to a video data signal using a preset gamma data group corresponding to the received luminance level.

* * * * *